US012129658B2

(12) United States Patent
Bauer

(10) Patent No.: US 12,129,658 B2
(45) Date of Patent: Oct. 29, 2024

(54) FILLER FRAMES FOR BUILDINGS WITH RIDGED PANELS

(71) Applicant: Mark Keller Bauer, Haslet, TX (US)

(72) Inventor: Mark Keller Bauer, Haslet, TX (US)

( * ) Notice: Subject to any disclaimer, the term of this patent is extended or adjusted under 35 U.S.C. 154(b) by 210 days.

(21) Appl. No.: 17/884,987

(22) Filed: Aug. 10, 2022

(65) Prior Publication Data

US 2023/0053302 A1 Feb. 16, 2023

Related U.S. Application Data

(60) Provisional application No. 63/231,514, filed on Aug. 10, 2021.

(51) Int. Cl.
*E04F 13/08* (2006.01)

(52) U.S. Cl.
CPC ..... *E04F 13/0864* (2013.01); *E04F 13/0889* (2013.01)

(58) Field of Classification Search
None
See application file for complete search history.

(56) References Cited

U.S. PATENT DOCUMENTS 3,124,224 A * 3/1964 Paul et al. ..... E06B 1/12 52/211
3,771,582 A * 11/1973 Hairston ..... E06B 7/084 160/90
8,397,468 B2 3/2013 McClure
9,057,220 B2 * 6/2015 Carlson ..... E06B 3/4618
11,761,259 B2 * 9/2023 Aaron ..... E06B 1/6015 52/215
2022/0042366 A1 * 2/2022 Aaron ..... E06B 1/6015
2023/0053302 A1 * 2/2023 Bauer ..... E06B 1/12

FOREIGN PATENT DOCUMENTS

CN 210948245 U * 7/2020

OTHER PUBLICATIONS

Skylightsplus, skylight appearing at website <http://skylightsplus.au>, screenshot dated Nov. 10, 2021.
Bluescope Buildings North America, Inc., skylights appearing at website <https://www.butlermetalbuilding.com/products>, screenshot dated Nov. 10, 2021.

* cited by examiner

*Primary Examiner* — Joshua K Ihezie

(57) ABSTRACT

Filler frames for mounting on exterior or interior surfaces of metal building siding panels, and also configurable for mounting around cut-out openings in siding panels. Filler frames include one or more connected frame panels having a substantially flat top portion, and a bottom portion having a bottom surface that is shaped to nest on and mate with a correspondingly shaped portion of a repeating ridge pattern of the respective building side panel on which each of the frame panels is configured to be mounted upon, thus leaving no gaps between the filler frame and the building siding panels. Frame panels of filler frames may alternatively have one or more foam portions attached to a bottom surface providing for an effective seal. One or more gaps are formed in such foam portions to facilitate the use of fasteners for mounting of the filler frame to a building siding panel.

1 Claim, 13 Drawing Sheets

FILLER FRAMES FOR BUILDINGS WITH RIDGED PANELS

CROSS-REFERENCE TO RELATED APPLICATION

This application claims priority to U.S. Provisional Patent Application No. 63/231,514, filed on Aug. 10, 2021, titled "Filler Frames for Buildings with Ridged Panels," the complete disclosure of which is incorporated herein by reference in its entirety.

BACKGROUND OF THE INVENTION

Technical Field

The present invention relates generally to novel frames for building construction and more particularly, to filler frames for mounting around cut-out openings, and for use as a flat mounting surface, said filler frames having interior sides configured to nest on, and mate with, building siding panels having repeating ridge patterns, such filler frames having exteriors sides having substantially flat surfaces optimized for maintenance and for ease of mounting of other objects thereon, and to improve aesthetic appearances.

Description of Related Art

The construction of metal buildings and other residential, commercial, and agricultural structures has grown increasingly popular in recent years. Much of the popularity associated with metal buildings, also sometimes referred to as "steel buildings," arises from the numerous construction and maintenance related advantages of such buildings as compared to buildings constructed of other types of materials. For example, metal buildings are typically more long-lasting, and more resistant to fire, termites, mold, mildew, and the effects of extreme weather. In short, metal buildings usually require less maintenance than buildings made of other materials. Moreover, metal buildings are often more energy efficient and less expensive to insure as compared to buildings made of materials such as wood or brick. The construction of metal buildings, which often utilizes prefabricated steel siding, also leads to shorter construction times and lower overall construction costs.

Metal buildings typically utilize prefabricated steel siding panels having repeating patterns of ridges or "ribs," which enhance the bending strength and rigidity of such panels. Ridges formed in siding panels may be oriented vertically, which is the ridge pattern illustrated in the drawings depicted herein. However, ridges formed in siding panels may alternatively be oriented horizontally. Apart from utilitarian advantages realized from the use of steel siding panels having repeating ridge patterns, the appearance of such ridges or ribs on steel panels are often considered more aesthetically pleasing as compared to structures constructed using other materials. Further, the use of such ridged steel panels often facilitates the joining of such panels during the construction process, as the ridges are capable of interlocking/mating with one another, enhancing the strength of the attachment of the panels, and reducing construction time and overall construction costs as noted above.

A commonly utilized repeating ridge pattern found in prefabricated steel panels is referred to as "R-panel" panels, and it features a repeating pattern comprising a major ridge every twelve (12) inches, followed by two minor ridges, and then another major ridge. Prefabricated steel siding of the type used to construct metal buildings is often 22 to 26 "gauge" in thickness, which translates into thicknesses of 0.179 inches to 0.0299 inches, with ridge heights ranging from ⅛ inch to 1½ inch tall of various patterns. Those of ordinary skill in the art will recognize that there are numerous other types of repeating ridge patterns, some of which are discussed below, utilized in connection with steel panels and panels made of other types of materials used in the construction of buildings and other structures.

During or after the construction of metal buildings, it is typically necessary to form "cut-outs" in the building siding panels, which are holes/apertures/openings formed in a metal siding panel, or more frequently, a plurality of adjoining metal siding panels. Such cut-outs are formed for the purpose of placing windows, vents, exhaust fans, doors, and other items commonly found on metal buildings that require such a cut-out. It is also common during or following the construction process for builders or owners of metal buildings to desire to mount objects on the interior or exterior of metal building panels. Such objects may include, but are not limited to, building accessories such as light fixtures, shutters, video cameras, alarm components, and decorative objects.

Frames comprising vertical and horizontal frame panels attached to one another to form a perimeter, with a frame aperture encircled by said perimeter around a cut-out opening, are typically employed to provide a structure upon which to mount a window, exhaust fan, door, or some other object on the exterior and/or interior side of one or more steel panels around said cut-out and within said frame aperture. As used herein, the term "horizontal," when used to refer to the orientation of a frame panel, should be interpreted to mean a frame that is elongated perpendicular to the orientation of the ridges formed on the siding panel to which it is mounted. As used herein, the term "vertical," when used to refer to the orientation of a frame panel, should be interpreted to mean a frame that elongated parallel to the orientation of the ridges formed on the siding panel to which it is mounted. Conversely, for those buildings utilizing siding panels with ridges oriented horizontally, the terms "horizontal" and "vertical" will correspond to the commonly used meanings of such terms, but the meaning of such terms will be reversed when used to describe the frame panels used for mounting on building utilizing side panels with horizontally oriented ridges. While such frames are often rectangular/square in shape, having vertical and horizontal frame panels, frame panels may also take other shapes and include non-linear frame panels configured to form a perimeter around a rectangular or non-rectangular cut-out. Likewise, one or more frame panels having rectangular and non-rectangular shapes are also utilized to mount the aforementioned building accessories to the exterior or interior of metal buildings.

Referring now to FIG. 1A, a perspective view of a prior art frame (102) mounted on an exterior side of a metal building having steel siding panels (104) around a cut-out (not visible) formed for the purpose of mounting an exhaust fan (106) to a metal building. The steel panels, which in this exemplary illustration are R-Panel type steel panels, have exterior and interior surfaces consisting of repeating ridge patterns (108) with major ridges (110) and minor ridges (112), said major ridges having a greater ridge height as compared to the ridge height of minor ridges. The frame, in this embodiment consists of vertical frame panels (114) and horizontal frame panels (116), which are mounted on the exterior sides of the steel panels. Prior art horizontal and vertical frames have substantially flat top sides and undersides. The top sides of the frame panels are exterior facing when the frame is mounted on an exterior side of a metal building, but are interior facing when the frame is mounted on an interior side of a metal building. Conversely, the underside of the frame faces the steel panel to which the frame is mounted, regardless of whether the frame is mounted to an exterior or interior side of a metal building. The respective undersides of said vertical and horizontal frame panels span across the top sides of the aforementioned major ridges (110) when mounted to an exterior or interior side of a metal building. Between the major ridges and minor ridges are valleys (118) in the ridge pattern, said valleys have exterior surfaces lower in height than either of the major or minor ridges in the ridge pattern.

Referring now to FIG. 1B, a cross-sectional view of a horizontal frame panel (116) of the prior art frame mounted on an exterior side of a metal building having steel panels (104) as depicted in FIG. 1A. As can be more easily visualized with the aid of FIG. 1B, the underside (124) of the horizontal frame panel (116) makes contact with the steel panel to which it is mounted solely on the top surfaces of the major ridges (110) of the repeating ridge pattern of such steel panel. Thus, the horizontal frame panel spans across the minor ridges (112) and valleys (118), with gaps (120) formed between the horizontal frame panel and the steel panel. Although not depicted in FIG. 1B, it should be noted that prior art vertical panel frames likewise have undersides configured to span across the top side of major ridges, also leaving gaps between the steel panel and the vertical frame panels.

Prior art frames for mounting on steel panels having repeating ridge patterns have numerous drawbacks. One major drawback of such prior art frames arises from the existence of the aforementioned gaps (120) between the under sides of the frame panels and the major ridges of the repeating ridge patterns on the steel panels. The existence of such gaps results in decreased sealing properties of the frame because of the likelihood that air, water, and/or insects will egress and ingress the metal building with greater ease through such gaps. Another drawback of such gaps is that they result in decreased frame strength and rigidity to the cut-out edge. An even further drawback of the existence of such gaps between the frame and the siding panels is that they are not aesthetically pleasing, making the metal building appear unfinished due to the incongruous fit between the frame panels and the siding panels.

Therefore, what is needed is a frame configured for mounting on metal buildings having steel panels with repeating ridge patterns that does not result in the types of aforementioned gapping conditions noted above. In other words, a frame that "fills" the gaps, or a "filler frame." What is needed in such a filler frame is a frame configuration that does not result in gaps and therefore provides enhanced sealing properties that decrease instances of egress and ingress of air, water, and insects into and out of metal buildings. What is also needed in such a filler frame is a frame configuration that does not result in gaps and therefore has increased frame strength and rigidity to the cut-out edge. What is also needed in such a filler frame is a frame configuration that does not result in gaps and therefore is more aesthetically pleasing. What is also needed in such a filler frame is a frame configuration that does not result in gaps and therefore is better capable of mounting building accessories to exterior and interior sides of metal buildings. These and other needs are met by the embodiments of the filler frames for buildings with ridged panels described below with reference to the accompanying drawings.

BRIEF DESCRIPTION OF THE SEVERAL VIEWS OF THE DRAWINGS

The claimed invention(s) will be more fully understood by reference to the following detailed description of the preferred and alternate embodiments when read in conjunction with the accompanying drawings, wherein:

Figure 1A:
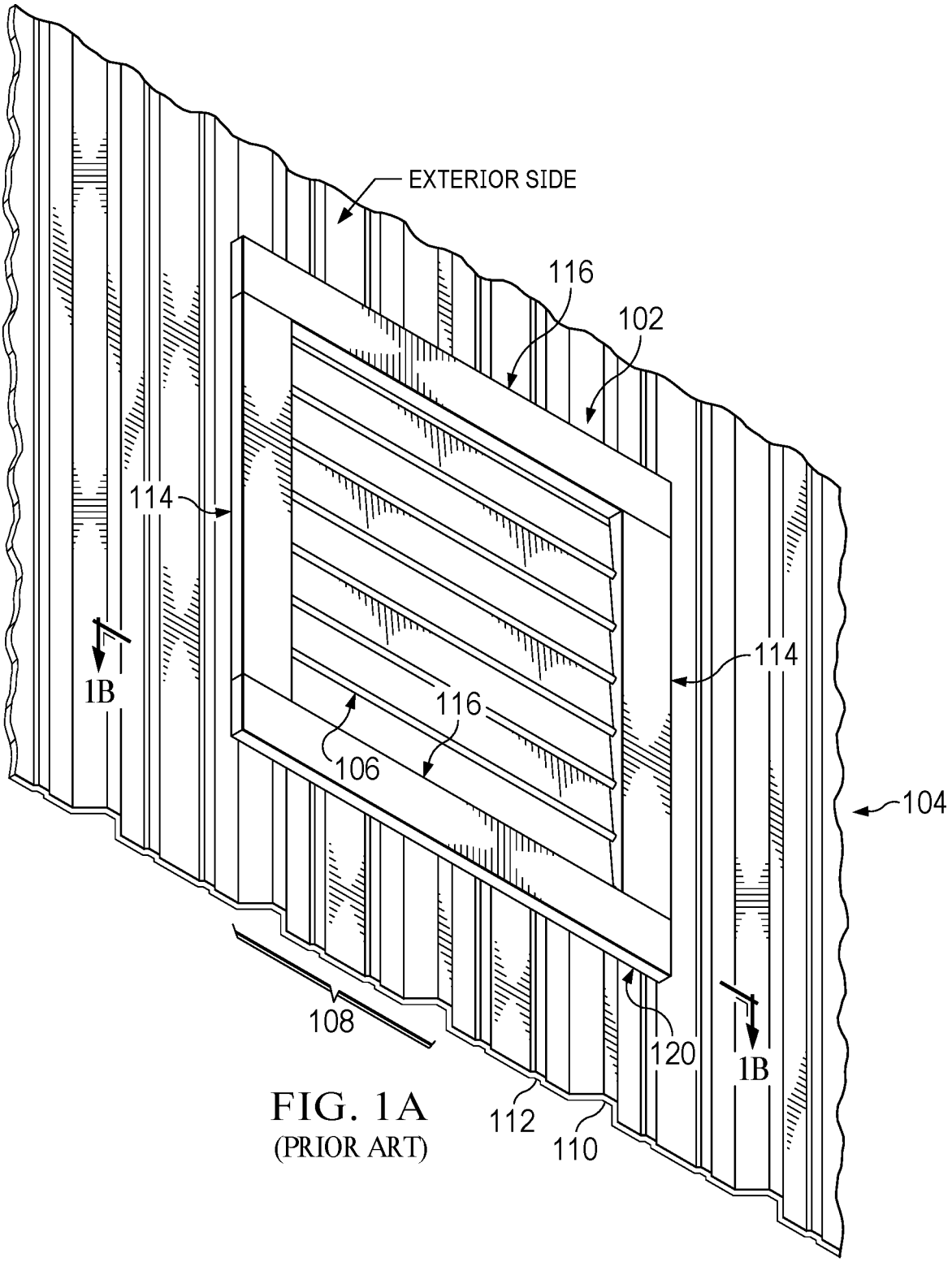
FIG. 1A (PRIOR ART)
FIG. 1A is a perspective view of a prior art frame mounted on exterior sides of R-Panel steel building panels around a cut-out formed with a customer supplied exhaust fan installed in a metal building.
Figure 1B:
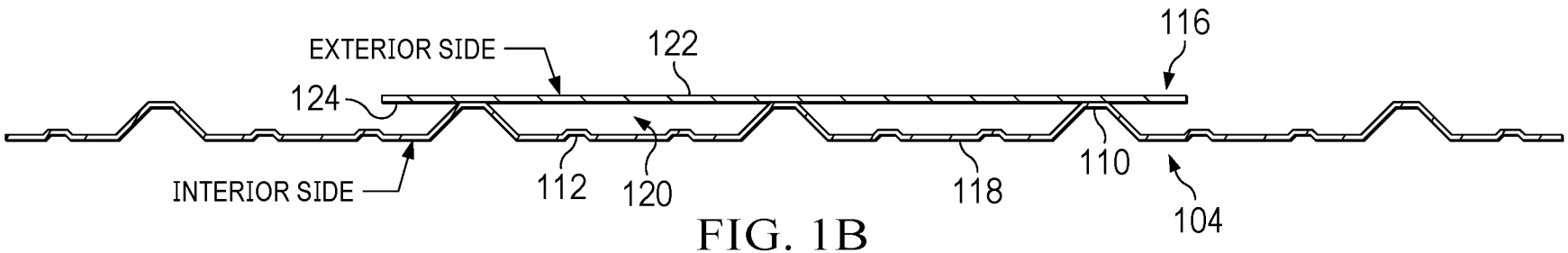
FIG. 1B (PRIOR ART)
FIG. 1B is a cross-sectional view of a horizontal frame panel of the prior art frame mounted on an exterior side of a metal building having steel panels as depicted in FIG. 1A.

The above figures are provided for the purpose of illustration and description only, and are not intended to define the limits of the disclosed invention. Use of the same reference number in multiple figures is intended to designate the same or similar parts. Furthermore, if and when the terms "top," "bottom," "under," "first," "second," "upper," "lower," "height," "width," "length," "end," "side," "horizontal," "vertical," and similar terms are used herein, it should be understood that these terms have reference only to the structure shown in the drawing and are utilized only to facilitate describing the particular embodiment. The extension of the figures with respect to number, position, relationship, and dimensions of the parts to form the preferred embodiment will be explained or will be within the skill of the art after the following teachings of the present invention have been read and understood.

DETAILED DESCRIPTION OF EMBODIMENTS OF THE INVENTION

Several exemplary embodiments of the claimed invention(s) will now be described with reference to the drawings. Unless otherwise noted, like elements will be identified by identical or corresponding numbers throughout all figures. The invention(s) illustratively disclosed herein suitably may be practiced in the absence of any element that is not specifically disclosed herein. The following description is not to be taken in a limiting sense, but is made merely for the purpose of describing the general principles of exemplary embodiments. The scope of the invention(s) should be determined with reference to the claims. Reference throughout this specification to "one embodiment," "an embodiment," or similar language means that a particular feature, structure, or characteristic described in connection with the embodiment is included in at least one embodiment of the inventions disclosed herein. Thus, appearances of the phrases "in one embodiment," "in an embodiment," and similar language throughout this specification may, but do not necessarily, all refer to the same embodiment except where otherwise noted. Furthermore, the described features, structures, or characteristics of the invention may be combined in any suitable manner in one or more embodiments. In the following description, numerous specific details are provided, such as examples of device structures, methods of use of the devices, etc., to provide a thorough understanding of embodiments of the invention(s). One skilled in the relevant art will recognize, however, that the invention(s) can be practiced without one or more of the specific details, or with other methods, components, materials, and so forth. In other instances, well-known structures, materials, or operations are not shown or described in detail to avoid obscuring aspects of the invention(s).

Disclosed herein are embodiments of inventive filler frames having interior sides (sides facing towards steel panel(s)) with surfaces shaped to mate and nest with correspondingly shaped surfaces of building siding such as steel panels having repeating ridge patterns, such filler frames having exteriors sides (sides facing away from steel panel(s)) having substantially flat surfaces optimized for maintenance and for ease of mounting of other objects thereon. It should be noted that while the exemplary embodiments of the filler frame components and assemblies described herein are configured for mounting upon and usage in conjunction with vertically oriented R-panel type ridge patterns such as those appearing in Purlin Bearing Rib ("PBR") panels, the invention(s) are also contemplated for use, in alternate embodiments, in conjunction with other types of metal building siding featuring various ridge patterns such as, for example, PBU, SM-Rib, Max-Rib, and other types of panels. Moreover, while the embodiments described herein are configured for mounting/installation on exteriors of metal buildings, the underlying concepts could be equally applied to the mounting of filler frames on interior (for example, see FIG. 9A) and exterior structures of buildings constructed of other types of non-metal materials, such as wood, polymers, concrete, alloys, etc. All dimensions described herein, and proportions depicted in the drawings of this disclosure, should be considered merely exemplary and non-limiting. The teachings herein may be equally applied to filler frames having various dimensions and proportions for mounting on building siding panels having ridge patterns, cut-out openings, and for use to mount building accessories, all having various sizes and proportions.

Figure 2B:
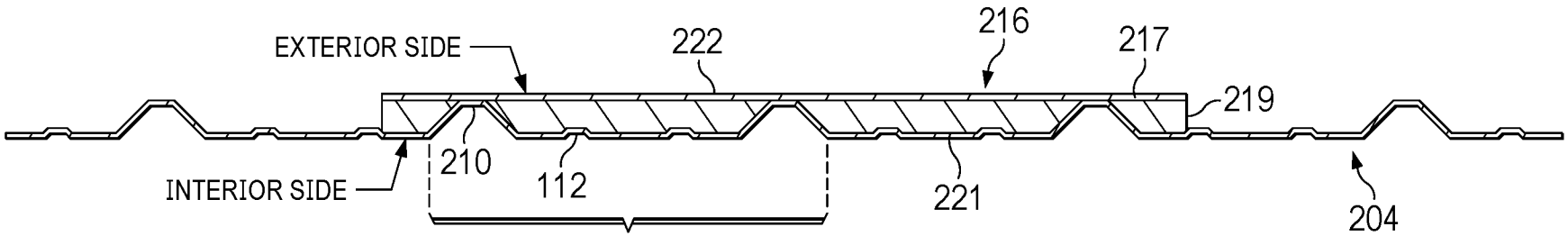
FIG. 2B is a cross-sectional view of a horizontal frame panel of the embodiment of the filler frame mounted on an exterior side of a metal building having steel panels as depicted in FIG. 2A.
Figure 2A:
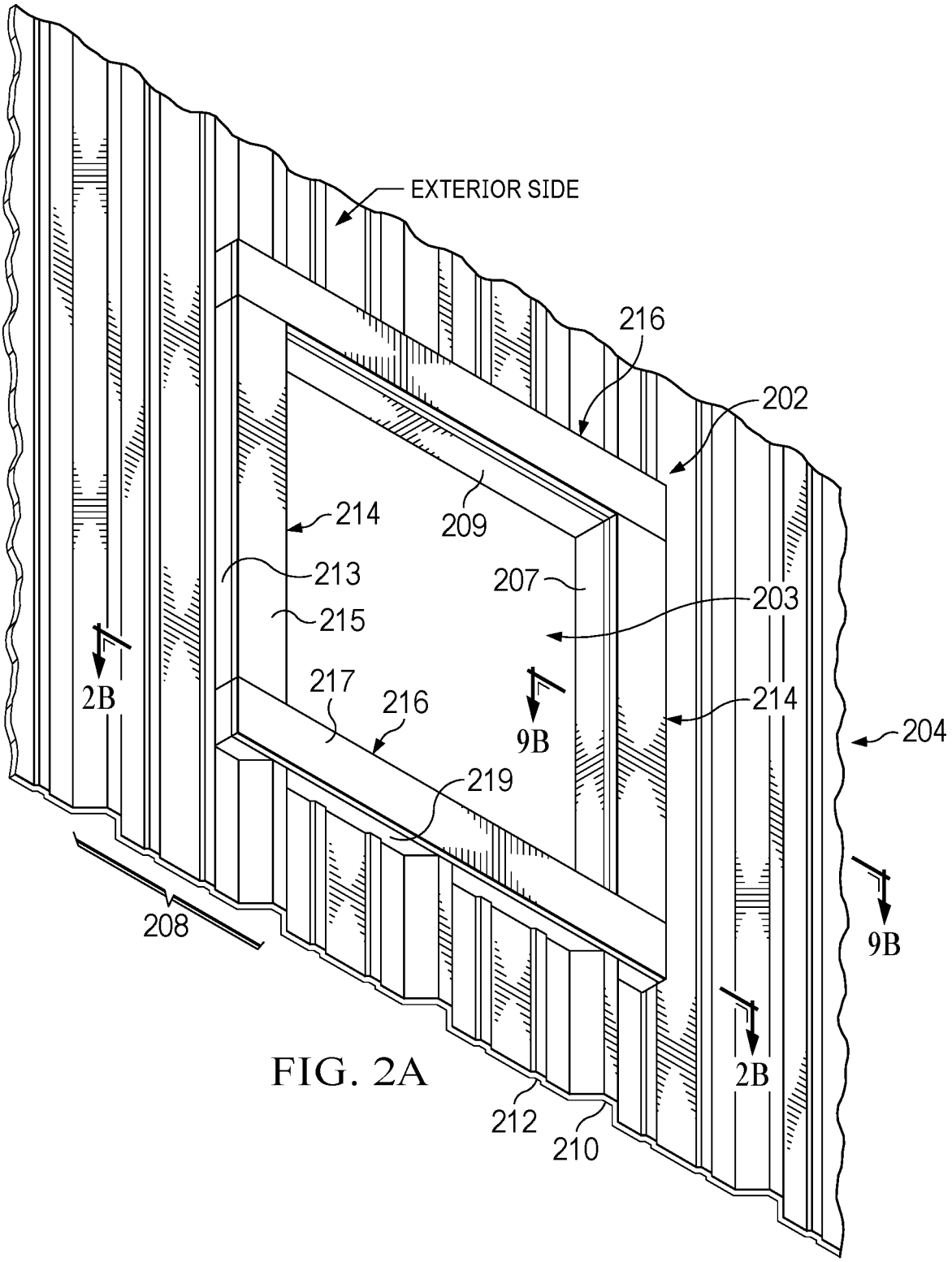
FIG. 2A is a perspective view of an embodiment of a filler frame of the present invention(s) mounted on exterior sides of R-Panel steel building panels around a cut-out formed in such steel building panels without a customer supplied accessory mounted thereon.

Referring now to FIG. 2A, shown is a perspective view of an embodiment of a filler frame (202) of the present invention(s) mounted on exterior sides of R-Panel steel building panels (204) around a cut-out opening formed in such steel building panels. The steel panels, which in this exemplary illustration are R-Panel type steel panels, have exterior and interior surfaces consisting of repeating ridge patterns (208) with major ridges (210) and minor ridges (212), said major ridges having a greater ridge height as compared to the ridge height of minor ridges. The filler frame, in this embodiment consists of vertical frame panels (214) and horizontal frame panels (216), which are mounted on the exterior sides of the steel panels. In one embodiment, the horizontal frame panels (216) are configured for mounting adjacent to a substantially horizontal segment of the panel cutout. Similarly, the vertical frame panels are in one embodiment configured for mounting adjacent to a substantially vertical segment of said cutout. The embodiment depicted in FIG. 2A is a filler frame for mounting around a cut-out opening (edges of cut-out obscured by frame panels) formed in one or more exterior or interior building siding panels (204) having repeating ridge patterns (208) formed thereon, said filler frame comprising in one embodiment a plurality of elongate frame panels (214, 216), each of the plurality of elongate frame panels being attached to at least two other of said plurality of elongate frame panels to form an enclosed frame perimeter having a central frame aperture (203). In one embodiment of the filler frame, the central frame aperture (203) is configured to be substantially aligned with the cut-out formed in the panel siding when the filler frame is mounted to said building siding panels. In one embodiment, optional horizontally oriented (209) and/or vertically oriented (207) cover panels may be at least temporarily attached to the bottom/top sides of horizontal frame panels and/or lateral sides of vertical frame panels, respectively, to cover/conceal the adjacent sides of such frame panels, cut-out edges, and/or building insulation until such time as an item (exhaust fan, window, door, etc.) is installed within the central frame aperture. In other embodiments, such cover panels may be absent. In such alternate embodiments in which cover panels are absent, the exposed edges of the panel frames, the edges of the metal cut-out opening, and building insulation will be visible until such time as the installation of the building accessory (exhaust fan, window, etc.) is installed and typically conceals such items. Further, as previously noted above, some buildings have ridges oriented horizontally. In those applications in which the building ridges are oriented horizontally, the frame filler design configurations of vertical frame panels taught herein would be applicable for the horizontal frame panels, and vice versa.

Now referring to FIG. 2B, shown is a cross-sectional view of a horizontal frame panel of the embodiment of the filler frame mounted on an exterior side of a metal building having steel panels (104) as depicted in FIG. 2A. Each of the plurality of elongate frame panels has a top portion (213, 217) and a bottom portion (215, 219), wherein the top portion each of the plurality of elongate frame panels has a substantially flat top side (222). In some embodiments of the filler frame, the entire top side of the plurality of elongate frame panels is flat, with no rises or protrusions thereon. In other embodiments of the filler frame, portions of the top side of the plurality of elongate frame panels are flat, with no rises or protrusions on said portions thereof. In one embodiment, each of the plurality of elongate frame panels has a bottom portion (213, 219) having a bottom surface (221) that is shaped to nest over, and mate with, a correspondingly shaped portion of said repeating ridge pattern (208) of said respective one or more exterior or interior building side panels (204) on which each of said plurality of elongate frame panels (214, 216) is configured to be mounted upon.

In one embodiment, the top portion and bottom portion of the frame panels are formed as a single structure. The top portion of the frame panel may be attached to the bottom portion to create the frame panel depicted in FIG. 2B. In one embodiment of the filler frame, the top portion of the frame panel is attached to the bottom portion of the frame panel using an appropriate adhesive (often cross-linking polyvinyl acetate) and 16-gauge brad nails, although it is contemplated that other types of adhesives, bonding materials, fasteners, and means for joining materials may be utilized. It is also contemplated that in other alternate embodiments, the frame panels of the filler frame may constitute a single material such that it is not necessary to attach the top portion to the bottom portion of the frame panel as they are unitary and integral to one another. In other words, it is contemplated that in some alternate embodiments, the top portion and bottom portion of each frame panel are formed as separate structures and bonded, fastened, or otherwise attached or joined together, but in other alternate embodiments the structures do not consist of separate parts.

Still referring to FIG. 2B, the bottom surface (221) of the bottom portion (219) of the frame panels (214, 216) are shaped to nest over, and mate with, a plurality of correspondingly shaped sequences of the repeating ridge patterns, which may include one or more major ridges (210) and minor ridges (212), formed on one or more exterior or interior building siding panels. However, in alternate embodiments, it is contemplated that such frame panels may be configured so as to only nest/mate with a single sequence, or a partial sequence, or combinations thereof, of the repeating ridge patterns of the siding panels. In some embodiments of the filler frame, the entire bottom surface of the bottom portion may be shaped to nest over, and mate with, one or more correspondingly shaped sequence(s) of repeating ridge patterns formed on an exterior or interior one or more building side panels. In other embodiments of the filler frame, only a portion of a bottom surface of the bottom portion may shaped to nest over, and mate with, one or more correspondingly shaped sequence(s) of repeating ridge patterns formed on an exterior or interior one or more building side panels. It is further contemplated that the filler frames described herein may be utilized for mounting on siding panels having repeating ridge patterns that include the same type of ridge, having the same ridge height (in other words panel types having ridges all of the same type, size, and/or shape). Ideally, the frame panels, particularly the bottom surfaces of the bottom portions thereof, are shaped to nest over correspondingly shaped repeating ridge patterns of said respective building siding panels to which each of said frame panels are configured to be mounted upon such that no gaps exist therebetween. However, in some alternate embodiments of the filler frames, it is possible that some gaps may exist between the bottom surface of one or more panel frames and the siding panels without falling outside the scope of the claimed inventions. Further, while the interior parts of the bottom portions of the panel frames are depicted as being substantially solid in the drawings of the filler frame embodiments depicted herein, it is contemplated that in alternate embodiments of filler frames, one or more hollow cavities (not shown) may be formed within the interior parts of the bottom portion of one or more of the frame panels so as to reduce the weight of the frame panels and overall filler frame. Such one or more hollow cavities formed within the interior of such bottom portions of the frame panels may have various sizes and shapes.

Figure 3:
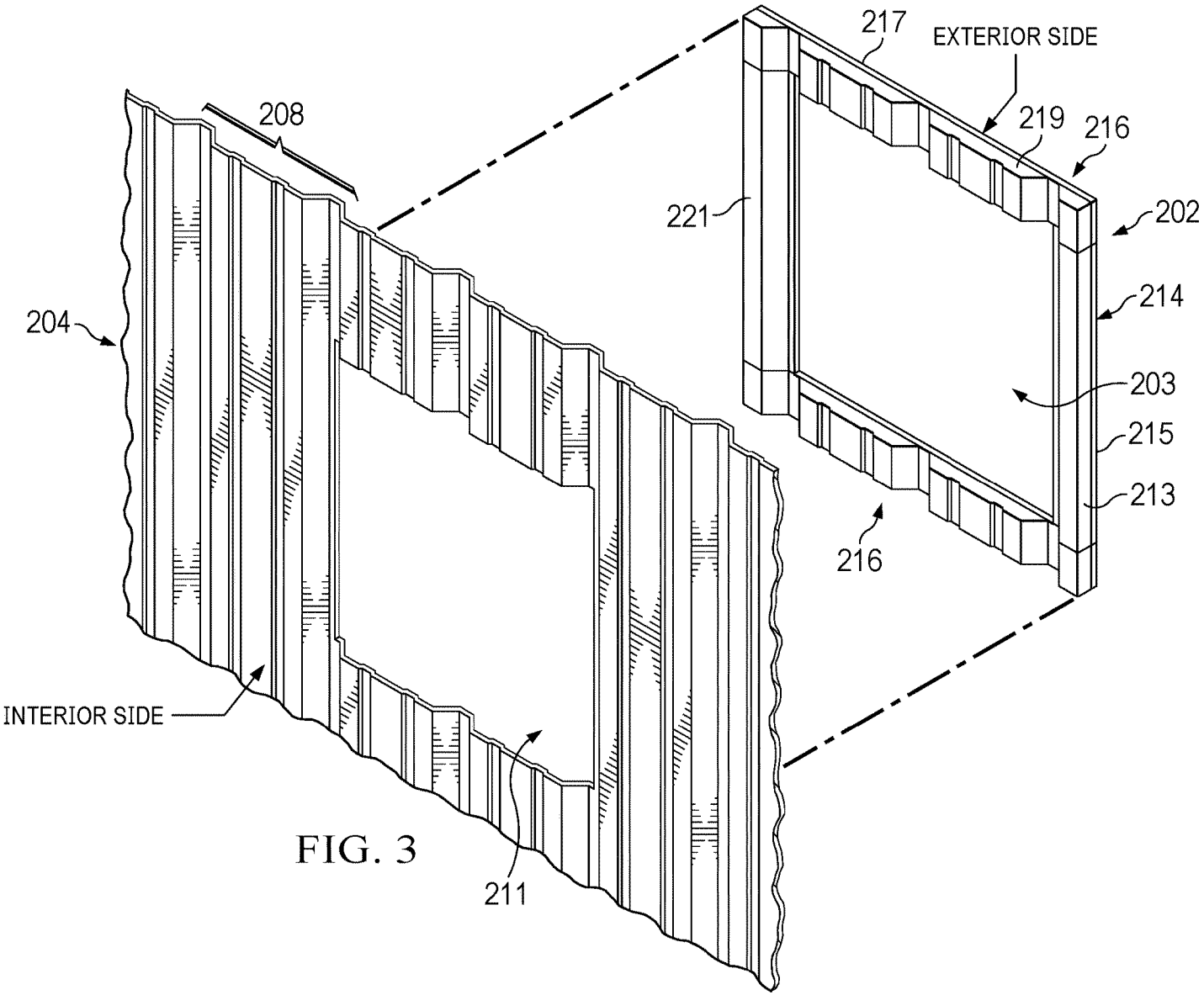
FIG. 3 is a rear perspective view of the embodiment of a filler frame of the present invention(s) mounted on exterior sides of R-Panel steel building panels around a cut-out formed in such steel building panels as depicted in FIG. 2A.

Referring now to FIG. 3, shown is a rear perspective view of the embodiment of a filler frame (202) of the present invention(s) mounted on exterior sides of R-Panel steel building panels (204) around a cut-out (211) formed in such steel building panels. The cut-out (211) or other opening is formed in the one or more steel building siding panels (204). One or more steel building panels are often attached to one another during the construction process such that a cut-out often involves making cuts to at least two or more adjoining building siding panels. Also depicted in FIG. 3 are the bottom surfaces (221) of the respective bottom portions (213, 219) and top portions (215, 217) of the frame panels. In this embodiment, the respective bottom surfaces of the bottom portions horizontal frame panels (216) and vertical frame panels (214) are undulating in shape, such shape being configured to nest on and mate with correspondingly shaped repeated ridge patterns (208) formed on the exterior sides of the building siding panels. FIG. 3 depicts how in one embodiment, the bottom surfaces of the horizontal frame panels are shaped to mate with multiple sequences of the repeating ridge patterns on the building side panels, while the bottom surfaces of the vertical frame panels are shaped to mate with only a partial sequence of the repeating ridge patterns on the building side panels upon which they are configured to be mounted upon. As noted above, alternate embodiments of the filler frame may be custom-configured to have bottom surfaces shaped to correspond to the unique shape of the repeated ridge pattern, and the particular one or more sequences thereof (or partial sequence), of the particular building side panel(s) to which the frame panels are to be mounted.

In one embodiment, the one or more frame panels of the filler frame can be fabricated from wood, polymer, metals, alloys, composite, or any other material that can be configured in the manner described and shown herein. The top portion and bottom portion of the frame panels may be constructed from the same type of material, but in other embodiments the top portion and bottom portion of the frame panels may be constructed of different materials (for example, see the embodiment of the filler frame depicted in FIG. 10 and described below). There are various different methods of installing the filler frames. One method is the use of sheet metal fasteners that penetrate the frame panels and the metal siding panels. Another method is to use wood screws that penetrate the frame panels, the metal siding panels, and a customer supplied interior frame. Adhesives may also be utilized to attach the frame to the building siding panels.

Due to the asymmetry of the repeating ridge patterns (often oriented vertically), the vertical panel frames and horizontal panel frames are distinctly different and have different designs. The inventive filler frame components and assemblies described herein provide numerous advantages including, but not limited to, allowing users to easily surround a cut-out opening with frame panels that: 1.) give the building cut-out or penetration edges strength and protects the edges from bending or damage; 2.) creates a flat surface on the exterior of the building at the cutout edge, allowing easier installation of exhaust fans, windows, or other accessories; 3.) closes the gap created by the ridges, which reduces drafts, water intrusion, and insect intrusion; and 4.) creates an aesthetically pleasing installation to a metal building.

Figure 4:
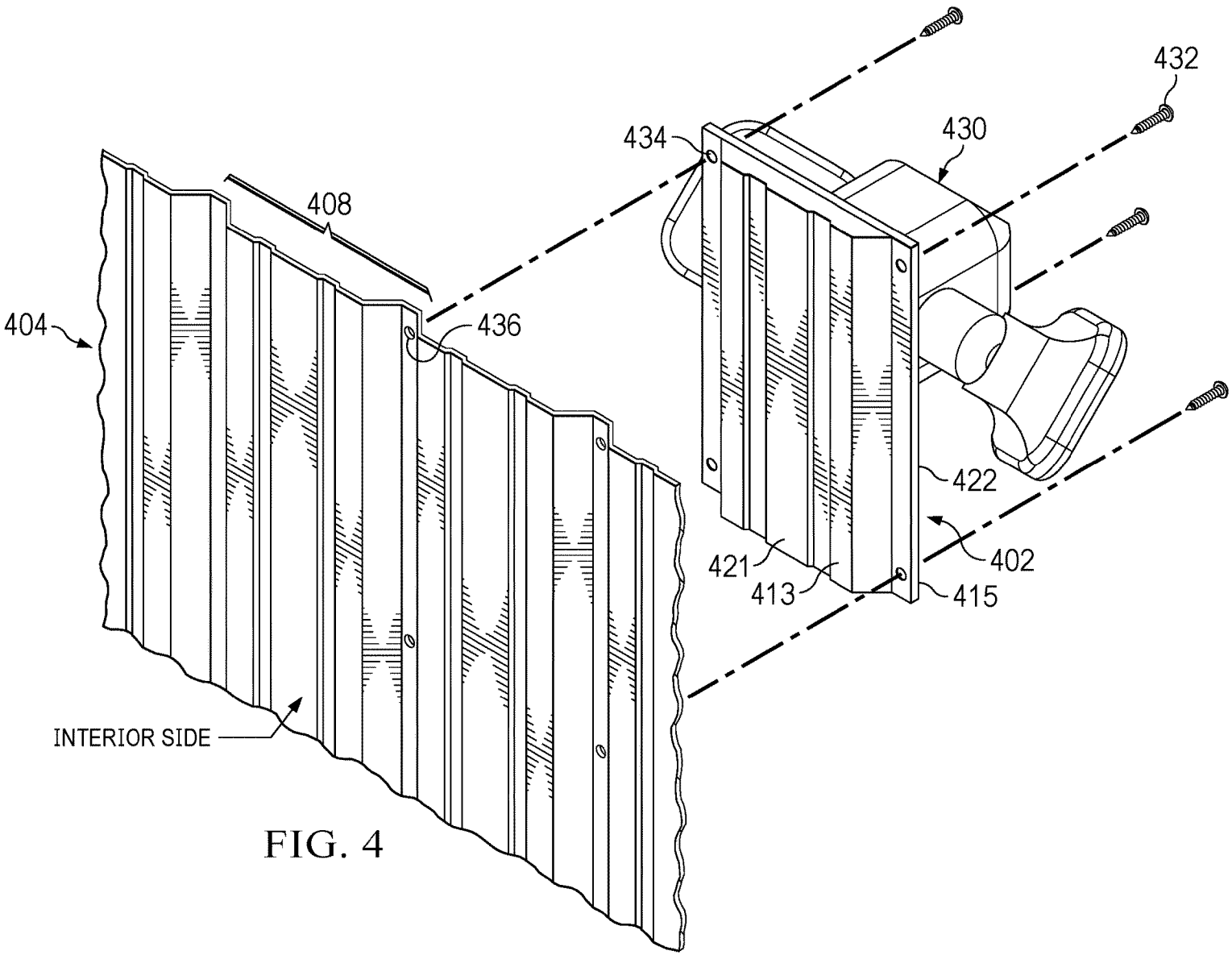
FIG. 4 is a rear perspective view of an alternate embodiment of a filler frame of the present invention(s) mounted on exterior sides of R-Panel steel building panels, said filler frame used as a flat surface on which building accessories may be mounted.

Referring now to FIG. 4, shown is a rear perspective view of an alternate embodiment of a filler frame (402) of the present invention(s) mounted on exterior sides of R-Panel steel building siding panels (404). In this alternate embodiment, the filler frame is intended to be utilized for the purpose of mounting a building accessory, such as an outdoor light fixture (430), to one or more siding panels not having a cut-out formed thereon. Other building accessories that may be mounted to an interior or exterior building siding panel in this manner in conjunction with a filler frame of the type described herein may also include, but are not limited to, shutters, motion sensors, alarm keypads and other alarm components, video cameras, and decorative objects. In this embodiment, a light fixture (430) is mounted to a top side (422) of the top portion (415) of the frame panel having no central aperture. One or more fasteners, such as screws (432), may be used to mount the filler frame (402) to the building siding panel(s) (404) having correspondingly positioned holes (434) formed therein to receive such mounting screws.

Still referring to FIG. 4, the bottom surface (421) of the bottom portion (413) of the frame panel is undulating in shape, such shape being configured to nest and mate with correspondingly shaped ridge patterns (408) formed on the exterior sides of the building siding panels. FIG. 4 depicts how in one embodiment the bottom surface of the frame panel is shaped to nest on, and mate with, one sequence of a ridge pattern on the building side panel(s). However, alternate embodiments of the filler frame may be custom-configured to have a bottom surface shaped to correspond to the unique shape of the ridge pattern, and the unique one or more sequences thereof (or partial sequence), of the particular building side panel(s) to which the frame panel is to be mounted.

Figure 5A:
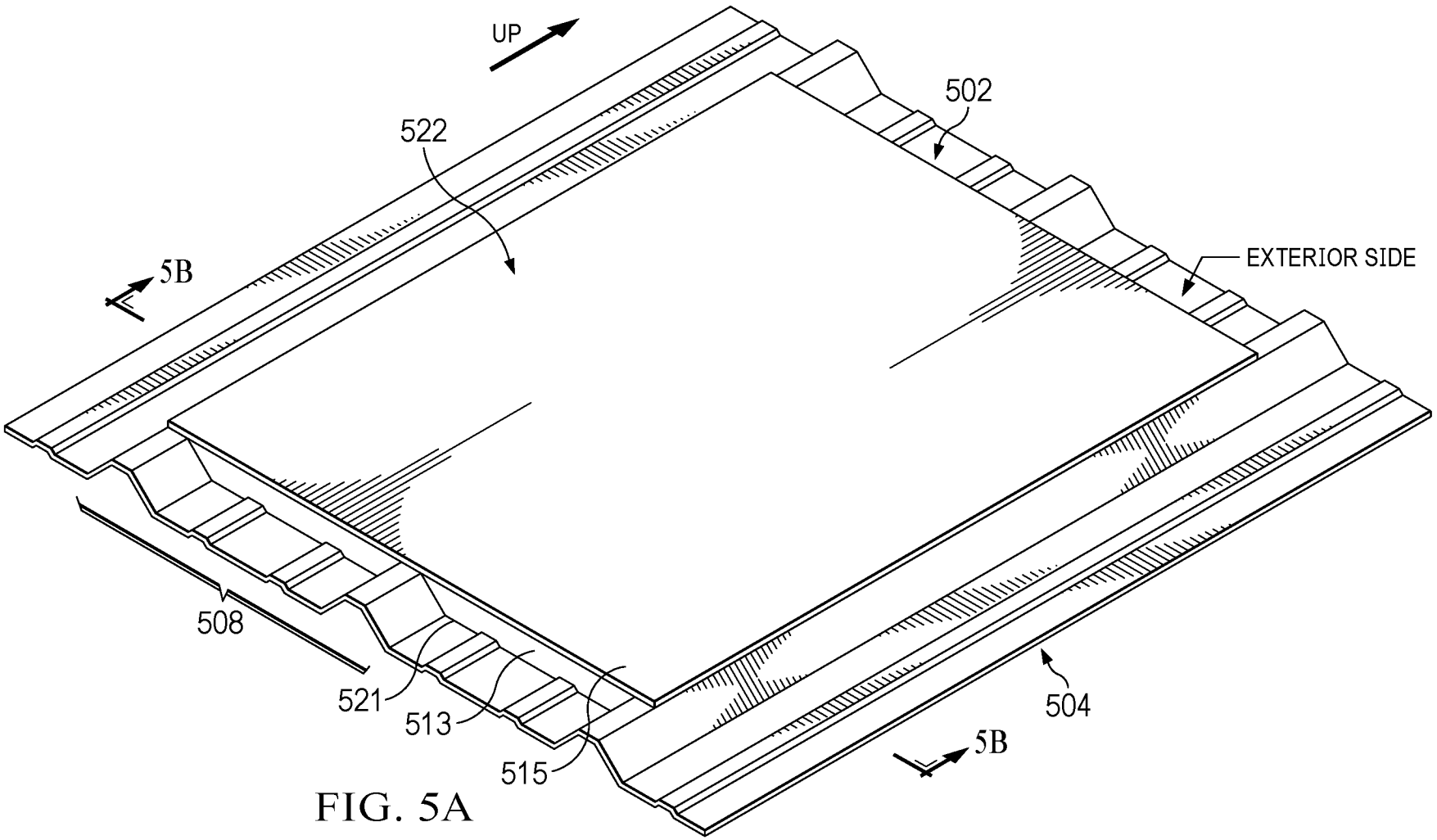
FIG. 5A is a front perspective view of a further alternate embodiment of a filler frame of the present invention(s) mounted on exterior sides of R-Panel steel building panels, said filler frame used as a flat surface on which building accessories may be mounted.

Now referring to FIG. 5A, shown is a front perspective view of a further alternate embodiment of a filler frame (502) of the present invention(s) mounted on exterior sides of R-Panel steel building panels (504). In this alternate embodiment, similar to the embodiment of the filler frame depicted in FIG. 4, the filler frame is intended to be utilized for the purpose of mounting a building accessory to one or more siding panels not having a cut-out formed thereon. One or more fasteners and/or adhesives may be used to mount the filler frame (502) to the building siding panel(s) (504). In some embodiments of the filler frame, such as the embodiment depicted in FIG. 5A, the entire top side (522) of filler frame is flat, with no rises or protrusions thereon. In other embodiments of the filler frame, portions of the top side are flat, with no rises or protrusions on said portions thereof. The bottom surface (521) of the bottom portion (513) of the frame panel is undulating in shape, such shape being configured to nest and mate with correspondingly shaped ridge patterns (508) formed on the exterior sides of the building siding panels. FIG. 5A depicts how in one embodiment the bottom surface (521) of the frame panel is shaped to nest on, and mate with, a plurality of sequences of a ridge pattern on the building side panel(s). In some embodiments of the filler frame, the entire bottom surface of the bottom portion may be shaped to nest over, and mate with, one or more correspondingly shaped sequence(s) of repeating ridge patterns formed on an exterior or interior one or more building side panels. In other embodiments of the filler frame, only a portion of a bottom surface of the bottom portion may shaped to nest over, and mate with, one or more correspondingly shaped sequence(s) of repeating ridge patterns formed on an exterior or interior one or more building side panels.

Figure 5B:
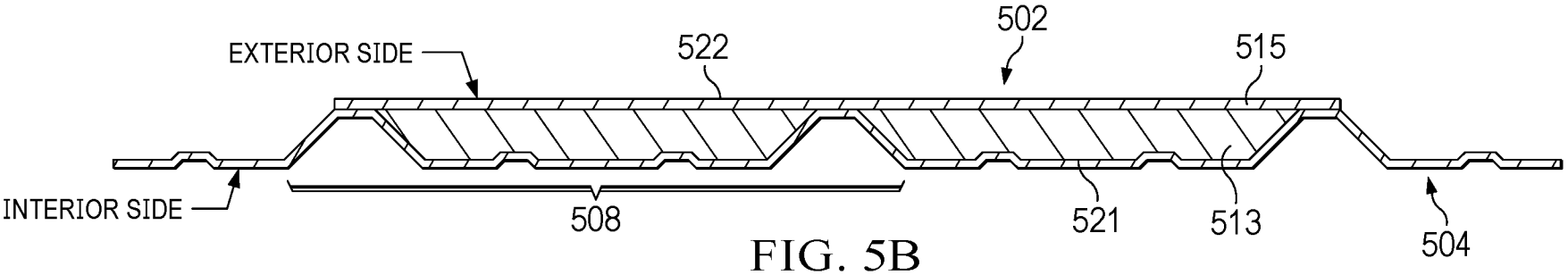
FIG. 5B is a cross-sectional view of the further alternate embodiment of a filler frame of the present invention(s) mounted on exterior sides of R-Panel steel building panels as depicted in FIG. 5A.

Now referring to FIG. 5B, shown is a cross-sectional view of the further alternate embodiment of a filler frame (502) of the present invention(s) mounted on exterior sides of R-Panel steel building panels (504) as depicted in FIG. 5A. The frame panel has a top portion (515) and a bottom portion (513), wherein the top portion of the frame panel has a substantially flat top side (522). The bottom portion (513) of the frame panel has a bottom surface (521) that is shaped to nest over, and mate with, a correspondingly shaped portion of the repeating ridge pattern (508) of the building side panels (504) on which the frame panels is configured to be mounted upon.

Figure 6A:
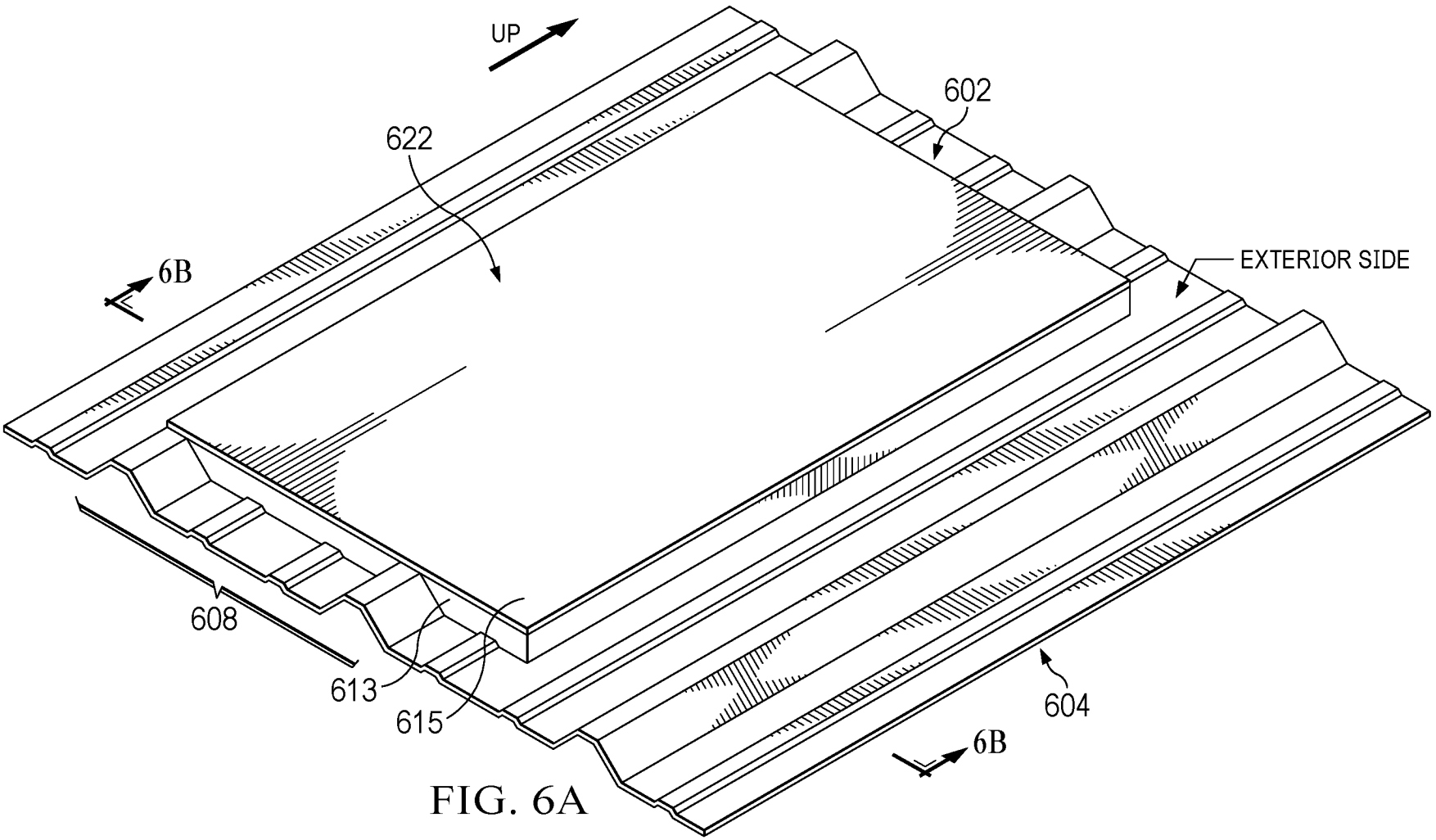
FIG. 6A is a front perspective view of a further alternate embodiment of a filler frame of the present invention(s) mounted on exterior sides of R-Panel steel building panels, said filler frame used as a flat surface on which building accessories may be mounted.

Now referring to FIG. 6A, shown is a front perspective view of a further alternate embodiment of a filler frame (602) of the present invention(s) mounted on exterior sides of R-Panel steel building panels (604). In this alternate embodiment, similar to the embodiment of the filler frame depicted in FIG. 4 and FIG. 5A, the filler frame is intended to be utilized for the purpose of mounting a building accessory to one or more siding panels not having a cut-out formed thereon. One or more fasteners and/or adhesives may be used to mount the filler frame (602) to the building siding panel(s) (604). The bottom surface (621) of the bottom portion (613) of the frame panel is undulating in shape, such shape being configured to nest on, and mate with, correspondingly shaped ridge patterns (608) formed on the exterior sides of the building siding panels. FIG. 6A depicts how in one embodiment the bottom surface (621) of the frame panel is shaped to nest and mate with a one full sequence and an adjoining partial sequence of a ridge pattern on the building side panel(s). The ability to custom-configure the width of the filler frame to suit a particular sequence or partial sequence, or combination thereof, of a repeated ridge pattern on a building siding panel is an additional advantage of the filler frames described herein.

Figure 6B:
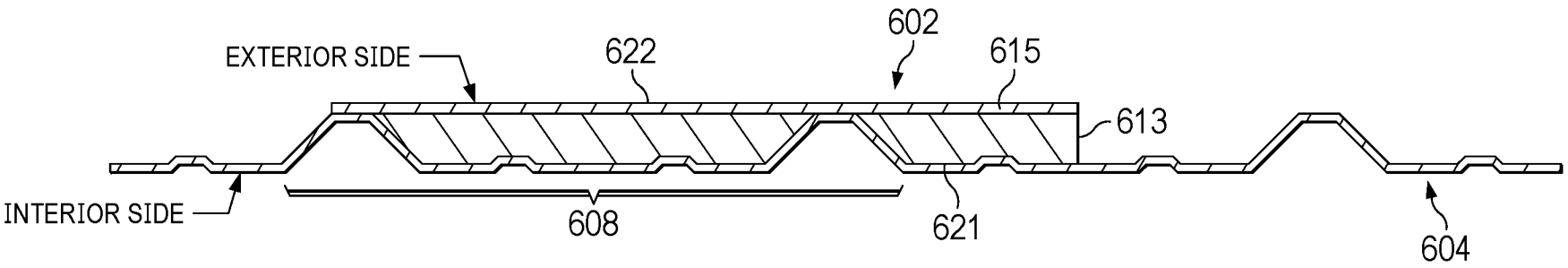
FIG. 6B is a cross-sectional view of the further alternate embodiment of a filler frame of the present invention(s) mounted on exterior sides of R-Panel steel building panels as depicted in FIG. 6A.

Now referring to FIG. 6B, shown is a cross-sectional view of the further alternate embodiment of a filler frame (602) of the present invention(s) mounted on exterior sides of R-Panel steel building panels (604) as depicted in FIG. 6A. The frame panel has a top portion (615) and a bottom portion (613), wherein the top portion of the frame panel has a substantially flat top side (622). The bottom portion (613) of the frame panel has a bottom surface (621) that is shaped to nest over, and mate with, a correspondingly shaped portion of the repeating ridge pattern (608) of the building side panels (604) on which the frame panels is configured to be mounted upon.

Figure 7A:
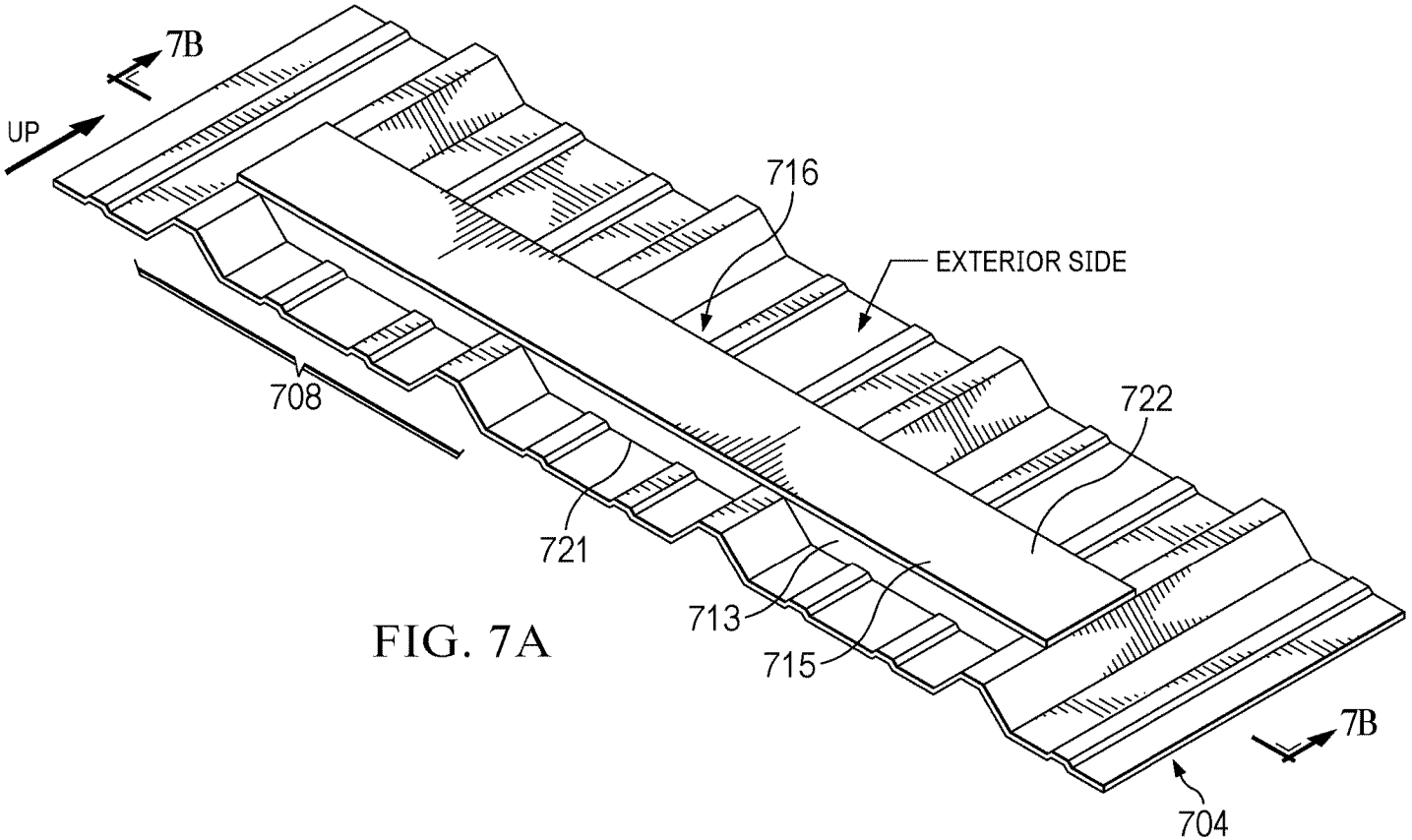
FIG. 7A is a front perspective view of a further alternate embodiment of a horizontal frame panel of an embodiment of a filler frame of the present invention(s) mounted on exterior sides of R-Panel steel building panels.

Now referring to FIG. 7A, shown is a front perspective view of an alternate embodiment of a horizontal frame panel (716) of an embodiment of a filler frame of the present invention(s) mounted on exterior sides of R-Panel steel building panels (704). In this alternate embodiment, the horizontal frame panel of the filler frame may be utilized for the multiple purposes. One purpose may include the mounting of a building accessory to one or more siding panels not having a cut-out formed thereon. Another purpose may be to utilize the horizontal frame panel in conjunction with other frame panels to form a frame perimeter around a cut-out opening in the building side paneling. One or more fasteners and/or adhesives may be used to mount the horizontal frame panel (716) to the building siding panel(s) (704). The bottom surface (721) of the bottom portion (713) of the horizontal frame panel is undulating in shape, such shape being configured to nest and mate with correspondingly shaped ridge patterns (708) formed on the exterior sides of the building siding panels. FIG. 7A depicts how in one embodiment the bottom surface (721) of the frame panel is shaped to nest and mate with a plurality of sequences of a ridge pattern on the building side panel(s).

Figure 7B:
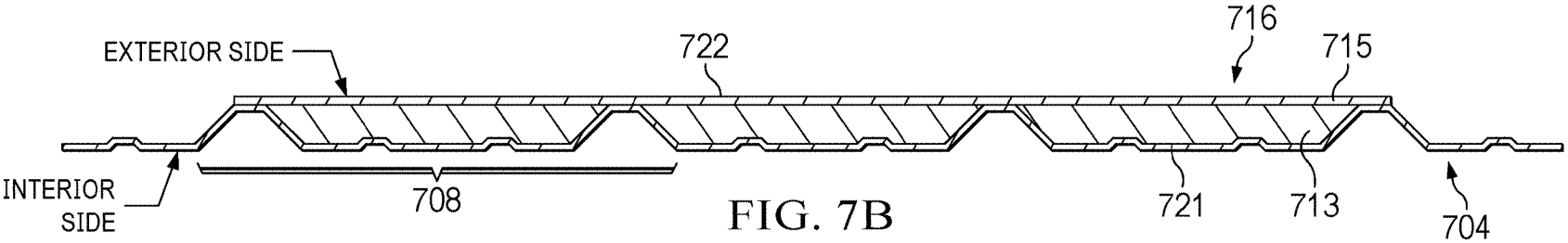
FIG. 7B is a cross-sectional view of the further alternate embodiment of a horizontal frame panel of an embodiment of a filler frame of the present invention(s) mounted on exterior sides of R-Panel steel building panels as depicted in FIG. 7A.

Now referring to FIG. 7B, shown is a cross-sectional view of the alternate embodiment of the horizontal frame panel (716) of the embodiment of a filler frame of the present invention(s) mounted on exterior sides of R-Panel steel building panels (704) as depicted in FIG. 7A. The horizontal frame panel (716) has a top portion (715) and a bottom portion (713), wherein the top portion of the frame panel has a substantially flat top side (722). The bottom portion (713) of the frame panel has a bottom surface (721) that is shaped to nest over, and mate with, a correspondingly shaped portion of the repeating ridge pattern (708) of the building side panels (704) on which the frame panels is configured to be mounted upon.

Figure 8:
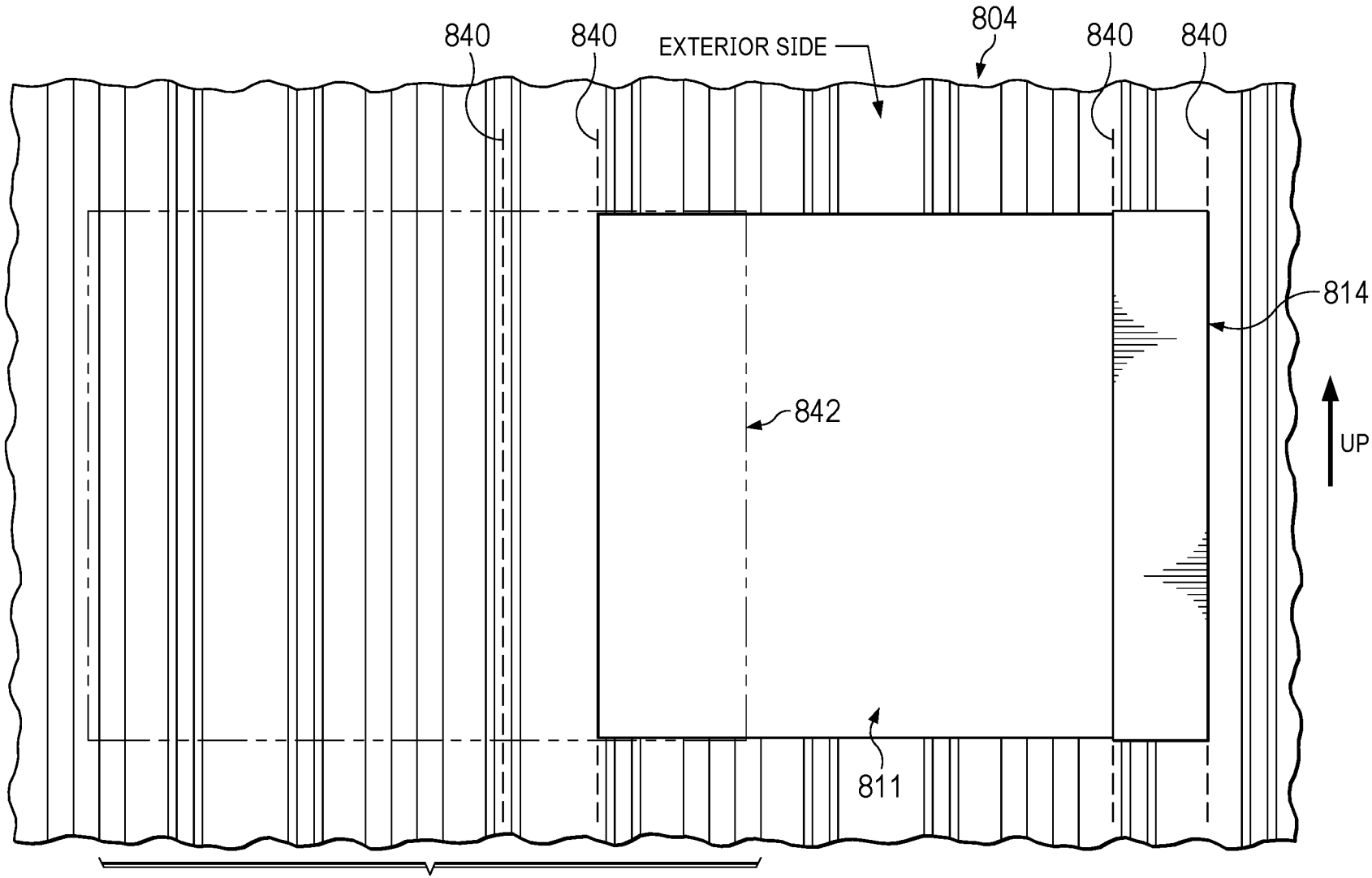
FIG. 8 is a front view of an alternate embodiment of an uncut vertical frame panel of an embodiment of a filler frame as delivered to a user.

Now referring now to FIG. 8, a front view of an embodiment of an uncut vertical frame panel (842) as delivered to a user, covering two full frame patterns (808), allowing a user to position the component in the ideal location, mark cut lines (840), and then trim the uncut vertical frame panels (814) into a final configuration ready for mounting on a building. In other words, in one embodiment, rather than provide a user with an already custom-configured vertical frame panel, an uncut/untrimmed vertical frame panel would be delivered to a user, who would then ideally trim and install the finished vertical frame panel onto a building. Although not depicted, uncut horizontal frame panels could also be delivered to users, allowing the user to measure and trim the horizontal frame panel(s) to fit the particular size and ridging patterns of the building siding panel to which the frame panel(s) will be mounted. In alternate embodiments, end-users may provide more detailed measurements of the building ridge pattern and cutout position to a supplier of the inventive filler frames to enable such supplier to cut the vertical and/or horizontal frame panel(s) of the inventive filler frame before shipping such frame panel(s) to the end-user. It should further be noted that the minimum total height of the vertical frame panels is dictated by the dimensions of the particular cut-out, although the actual total height may exceed such minimum total height if the user desires the frame filler to have a larger border surrounding the cutout. It should be further noted that the thickness of the vertical frame panel will vary according to the location within the ridge panel pattern upon which it will be mounted. The drawings depicted herein show the building's ridges oriented vertically. However, as noted above, some buildings have ridges oriented horizontally. In those cases in which the building ridges are oriented horizontally, the frame filler designs of vertical frame panels would be applicable for the horizontal frame panels, and vice versa.

It should be noted that while some of the embodiments of the filler frames described herein are intended for use in providing a frame around a square or rectangular cut-out opening, the concepts described herein, with only minor modifications, could be configured to provide a filler frame for mounting around cut-out openings having a myriad of different shapes and sizes. Such minor modifications would only entail cutting or forming the filler frame panels or in some alternate embodiments, a unitary frame panel, to conform to the cut-out opening shape and the particular ridge patterns surrounding the cutout edges. In one embodiment, users may be supplied with, for example, a compressible high density impression foam (for example, Bio-Foam branded impression foam) to press against the cut-out area, and the area surrounding the cut-out (or even just one horizontally oriented impression), thus making a mold of the cutout and surrounding ridge patterns. Such a lightweight mold, together with dimensions of the cutout, could then be shipped to the supplier of filler frames at low cost, allowing the supplier or a separate manufacturer to manufacture a custom filler frame having dimensions and ridge patterns corresponding to the dimensions and ridge patterns found on the mold. In another embodiment, users may be provided with instructions for taking a set of photographs of the cut-out and surrounding ridge patterns, and further providing dimensional information to a supplier of filler frames, allowing the supplier or other manufacturer to manufacture custom filler frames based on such photographs and dimensional information.

Figure 9A:
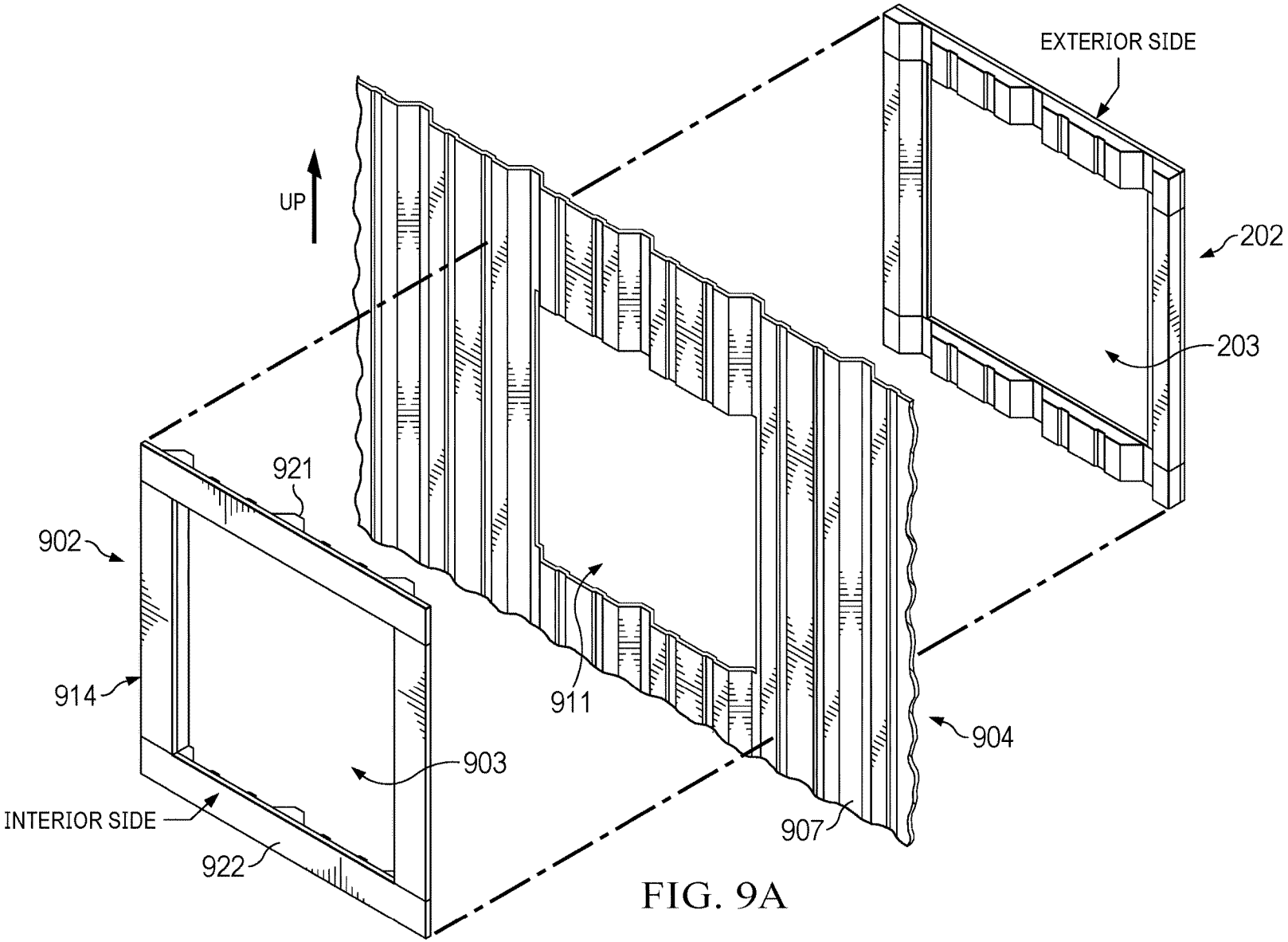
FIG. 9A is a rear perspective view of the embodiment of the filler frame of the present invention(s) mounted on exterior sides of R-Panel steel building panels around a cut-out formed in such steel building panels as depicted in FIG. 3, shown in use with a further embodiment of the filler frame of the present invention(s) mounted on interior sides of such R-Panel steel building panels.

Now referring to FIG. 9A, shown is a rear perspective view of the embodiment of the filler frame (202) of the present invention(s) mounted on exterior sides of R-Panel steel building panels (904) around a cut-out (911) formed in such steel building panels as depicted in FIG. 3, shown in use with a further embodiment of the filler frame (902) of the present invention(s) mounted on interior sides (907) of such R-Panel steel building panels (904). As depicted in FIG. 9A, alternate embodiments of the filler frames may easily be modified for mounting on interior facing sides (907) of building siding panels. With such interior mounted alternate embodiments, the substantially flat top surfaces (922) of the top portions of the frame panels face the interior of the metal building, while the bottom surfaces (921) of the bottom portions of the frame panels are configured to nest on, and mate with, the interior surfaces (907) of the building siding panels (904). The central aperture (903) of the filler frame may in this embodiment be configured for mounting to the building siding panels such that such central aperture (903) is substantially aligned with the cut-out opening (911), and may also be further substantially aligned with the central aperture (203) of the filler frame (202) mounted to the exterior of the building siding panels.

Figure 9B:
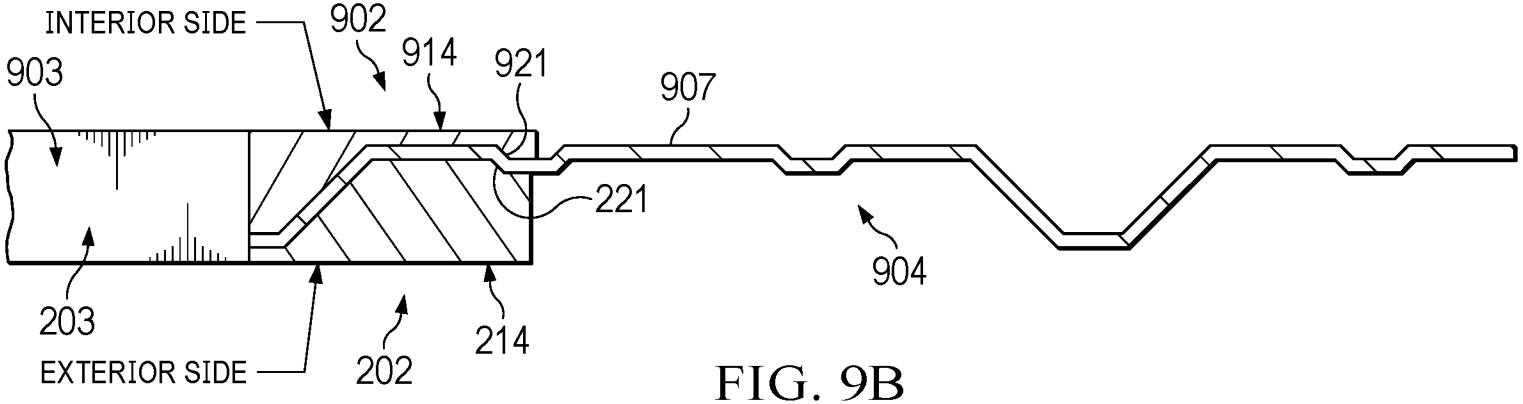
FIG. 9B is a cross-sectional view a vertical frame panel of the embodiment of the filler frame mounted on an exterior side of a metal building having steel panels as depicted in FIG. 2A, and further showing a cross-sectional view of an adjacently mounted alternate embodiment of a vertical frame panel (902) mounted on an interior side of said steel panels as depicted in FIG. 9A.

Now referring to FIG. 9B, shown is a cross-sectional view a vertical frame panel of the embodiment of the filler frame mounted on an exterior side of a metal building having steel panels as depicted in FIG. 2A, and further showing a cross-sectional view of an adjacently-mounted alternate embodiment of a vertical frame panel (902) mounted on an interior side of said steel panels as depicted in FIG. 9A. It should be noted that the vertically oriented cover panel (207) appearing in FIG. 2A has been omitted in this cross-sectional view at FIG. 9B. In the embodiments of the vertical frame panels (214, 914) depicted in FIG. 9B, such frame panels do not consist of top portions and bottom portions, but each vertical frame panel is instead unitary in construction, each having a substantially flat top side facing outward away from the side of the building siding panel to which the respective frame panels are mounted. In these alternate embodiments, each vertical frame panel has a respective bottom surface (221, 921) that is shaped to nest on, and mate with, a correspondingly shaped ridge pattern to which such bottom surface abuts. In this embodiment, the central aperture (203) of the filler frame mounted to the exterior of the building siding panels and the central aperture (903) of the filler frame mounted to the interior of the building siding panels are substantially aligned.

Figure 10:
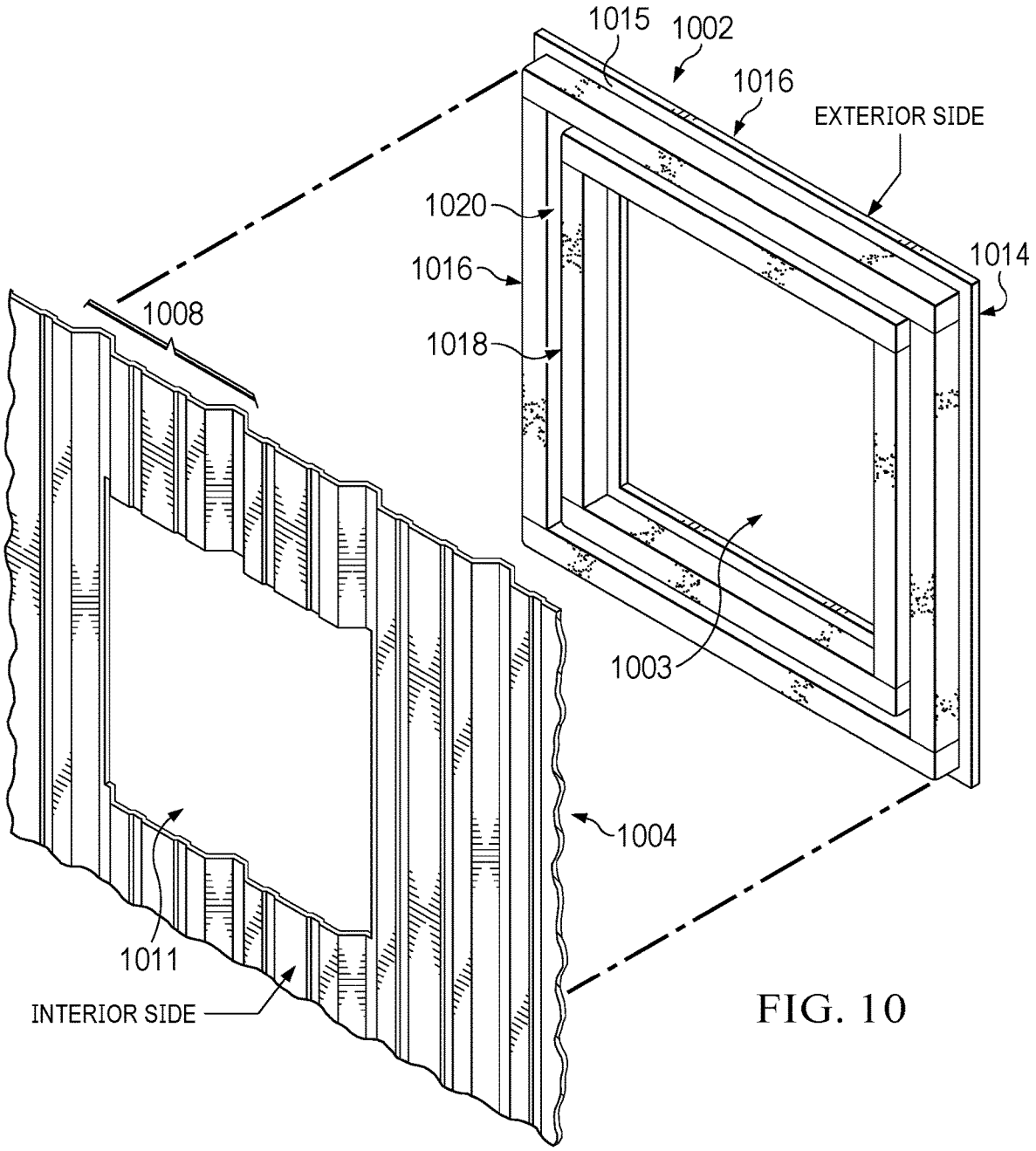
FIG. 10 is a rear perspective view a further alternate embodiment of the filler frame of the present invention(s) mounted on exterior sides of R-Panel steel building panels around a cut-out formed in such steel building panels.

Now referring to FIG. 10, shown is a rear perspective view a further alternate embodiment of the filler frame (1002) of the present invention(s) mounted on exterior sides of R-Panel steel building panels around a cut-out formed in such steel building panels. In one embodiment, depicted is a further alternate embodiment of filler frame (1002) for mounting on one or more exterior or interior building siding panels (1004) having repeating ridge patterns (1008) formed thereon. In one embodiment, one or more frame panels, which may include one or more horizontal frame panels (1016) and/or one or more vertical frame panels (1014), each have a substantially flat top side (not visible in FIG. 10, but same as top sides of other frame panels depicted herein). The frame panels have bottom portion having a bottom surface (1015) with a first inner strip of foam (1018) attached to an inside portion thereof, and a second outer strip of foam (1016) attached to an outside portion of the bottom surface. In one embodiment, a gap (1020) is formed on a bottom portion of each of said respective one or more frame panels, between said first inner strip of foam (1018) and said second outer strip of said foam (1016) such that no foam material exists within said gap (1020). The first inner strip of foam (1018) and said second outer strip of said foam (1016), both configured to face the surface of the building siding panel(s) to which the filler frame will be mounted, are configured to compress against said surface of the building siding panel(s) when mounted. The compression of the first inner strip of foam (1018) and said second outer strip of said foam (1016) against the surface of the building siding panel(s) works to form a seal between the filler frame and building siding panel(s). Such foam strips help to seal the filler frame and aid in preventing the egress and ingress of air, water, and insects into and out of metal buildings to which the filler frame is mounted. The filler frame, due to the sealing properties of the foam, is also more aesthetically pleasing. The positioning of the gap (1020) between the first inner strip of foam (1018) and said second outer strip of said foam (1016) is also advantageous in that gap allows for the use of fasteners, penetrating through the top sides of the frame panels and through filler frame to the building siding panel, to avoid the foam strips and thereby allow for greater ease of installation of the filler frame.

Still referring to FIG. 10, it should be noted by the reader that while the foam strips depicted herein are rectangular in shape, and consist of concentric rings of strips, alternate embodiments of the filler frame may utilize a greater or lesser number of foam portions, having various other shapes. Likewise, while the gaps between the foam strips depicted in FIG. 10 are channel-like in shape, it is contemplated that the gaps utilized in alternate embodiments of filler frames may comprise gaps having various other shapes. For example, in an alternate embodiment, a single unitary piece of foam, attached around the perimeter of the central frame aperture (1003), may have gaps/cavities formed in such foam at predetermined locations adjacent to holes in the frame panels, to allow for the unobstructed use of fasteners during the installation of the filler frame onto a building siding panel.

The invention may be embodied in other specific forms without departing from the spirit or essential characteristics thereof. The present embodiments are therefore to be considered in all respects as illustrative and not restrictive. Accordingly, the scope of the invention is established by the appended claims rather than by the foregoing description. All changes that come within the meaning and range of equivalency of the claims are embraced therein. Further, the recitation of method steps does not denote a particular sequence for execution of the steps. Such method steps may therefore be performed in a sequence other than that recited unless the particular claim expressly states otherwise.

I claim:

1. A filler frame for mounting on one or more exterior or interior building panels having repeating ridge patterns formed thereon, said filler frame comprising:

one or more frame panels, each of said one or more frame panels having an exterior portion and an interior portion, wherein said exterior portion each of said one or more frame panels has a substantially flat exterior side, wherein said interior portion of each of said one or more frame panels has an interior surface with a first inner strip of foam attached to an inside portion thereof, wherein a second outer strip of foam is attached to an outside portion of said interior surface of said interior portion of each of said one or more frame panels, wherein a gap is formed on said interior surface of said interior portion of each of said respective one or more frame panels between said first inner strip of foam and said second outer strip of said foam such that no foam material exists within said gap, wherein said first inner strip of foam and said second outer strip of foam are configured to at least partially nest over and mate with said repeating ridge patterns;

wherein said one or more frame panels forms an enclosed frame perimeter having a central frame aperture, wherein said central frame aperture is configured to be substantially aligned with, when said filler frame is mounted to said one or more exterior or interior building panels, a cut-out formed in said one or more exterior or interior building panels, and wherein one or more cavities are formed in said first inner strip of foam or said second outer strip of foam at predetermined locations adjacent to holes formed in said frame panels.

* * * * *